United States Patent [19]

Takao et al.

[11] Patent Number: 4,747,387

[45] Date of Patent: May 31, 1988

[54] ELECTRONIC FUEL INJECTION CONTROL DEVICE FOR INTERNAL COMBUSTION ENGINES

[75] Inventors: Mitsunori Takao, Kariya; Takahiko Kimura, Nagoya, both of Japan

[73] Assignee: Nippondenso Co., Ltd., Kariya, Japan

[21] Appl. No.: 602,424

[22] Filed: Apr. 20, 1984

[30] Foreign Application Priority Data

Apr. 25, 1983 [JP] Japan ..... 58-072676

[51] Int. Cl.[4] ..... F02B 3/00

[52] U.S. Cl. ..... 123/494; 123/478; 123/492; 123/493; 123/488

[58] Field of Search ..... 123/478, 492, 494, 493

[56] References Cited

U.S. PATENT DOCUMENTS

| | | | |
|---|---|---|---|
| 4,245,605 | 1/1981 | Rice | 123/492 |
| 4,257,377 | 3/1981 | Kinugawa | 123/492 |
| 4,377,145 | 3/1983 | Nagaishi | 123/494 |
| 4,436,074 | 3/1984 | Nakatsuka | 123/494 |
| 4,440,119 | 4/1984 | Kobayashi | 123/492 |

*Primary Examiner*—Ronald B. Cox

*Attorney, Agent, or Firm*—Cushman, Darby & Cushman

[57] ABSTRACT

In an electronic fuel injection control device for an internal combustion engine, an A-D converter is provided to convert an analogue signal indicative of a physical value such as an intake manifold negative pressure or an amount of suction air to a digital value, and a computer is programmed to calculate an average of a plurality of the digital values successively converted during one rotation of the engine, to determine whether or not a difference between the preceding average of the digital signals and the following average of the digital signals is larger than a predetermined value indicative of a transient operation of the engine, if so determine a first optimum physical value based on an average of at least two digital values most newly converted during one rotation of the engine, and if not determine a second optimum physical value based on the average of the digital values, and to determine an optimum fuel injection time based on one of the first and second optimum physical values and in relation to rotational speed of the engine.

5 Claims, 4 Drawing Sheets

ELECTRONIC FUEL INJECTION CONTROL DEVICE FOR INTERNAL COMBUSTION ENGINES

BACKGROUND OF THE INVENTION

The present invention relates to a fuel injection control system for internal combustion engines, and more particularly to an electronic fuel injection control device for electrically controlling an amount of fuel supply into an internal combustion engine from a source of fuel in automotive vehicles.

In conventional electronic fuel injection control devices, physical values such as an amount of suction air, an intake manifold negative pressure in operation of an internal combustion engine are calculated, in general, to determine an amount of fuel supply into the engine from a source of fuel. However, such physical values pulsate due to reverse flow of combustion gases into the intake manifold synchronously caused at a frequency of explosion of air-fuel mixture in the combustion chamber. It has been, therefore, observed that the amount of fuel supply or the ratio of air-fuel fluctuates due to such pulsation of the physical values, resulting in disorder of rotational speed or output power of the engine. In order to overcome such problems, a Japanese Patent Early Publication No. 57-2433 discloses a fuel injection control system which is arranged to determine an amount of fuel supply in dependence upon an average amount of the air sucked into respective cylinder barrels of the engine during one rotation in its normal operation and further in dependence upon an amount of the air sucked into one of the cylinder barrels of the engine at a termination of one rotation in its transient operation for quick acceleration of the vehicle. In this type of fuel injection control system, a high speed analogue-to-digital converter such as a converter of the progressive conversion type is utilized to convert an analogue voltage representing the amount of suction air to a digital value at an extremely high speed e.g. several hundreds microseconds. During such high speed conversion of the analogue voltage, high frequency noises are converted together with the analogue voltage to cause an error in the digital value. As a result, there will occur an error in determination of the amount of fuel supply particularly based on a single digital value corresponding with the amount of suction air at the termination of one rotation of the engine.

SUMMARY OF THE INVENTION

It is, therefore, a primary object of the present invention to provide an improved electronic fuel injection control device which is arranged to minimize an influence of such an error caused by conversion of high frequency noises so as to determine an amount of fuel supply as accurately as possible particularly in transient operation of the internal combustion engine.

According to the present invention, the above object is accomplished by provision of an electronic fuel injection control device for an internal combustion engine having a source of fuel, and electrically operated fuel injection means for effecting fuel supply into the engine from the source of fuel during energization thereof, which fuel injection control device comprises first detecting means for detecting rotational speed of the engine to produce a first signal indicative of the detected rotational speed, second detecting means for detecting a physical value such as an amount of suction air, an intake manifold negative pressure or the like in operation of the engine to produce a second signal indicative of the detected physical value, an analogue-to-digital converter for converting the second signal to a digital value, and means for providing an average of a plurality of the digital values successively converted during one rotation of the engine.

The fuel injection control device further comprises means for determining whether or not a difference between the preceding average of the digital values and the following average of the digital values is larger than a predetermined physical value indicative of a transient operation of the engine, if so determining a first optimum physical value based on an average of at least two digital values most newly converted during one rotation of the engine, and if not determining a second optimum physical value based on one of the preceding and following averages of the digital values, means for determining an optimum fuel injection time based on one of the first and second optimum physical values and in relation to a value of the first signal and for producing an output signal indicative of the optimum fuel injection time, and means for energizing the fuel injection means in response to said output signal for the optimum injection time.

BRIEF DESCRIPTION OF THE DRAWINGS

Additional objects and advantages of the present invention will be more readily apparent from the following detailed description of certain preferred embodiments thereof when taken together with the accompanying drawings in which.

DETAILED DESCRIPTION OF THE PREFERRED EMBODIMENTS

Figure 1:
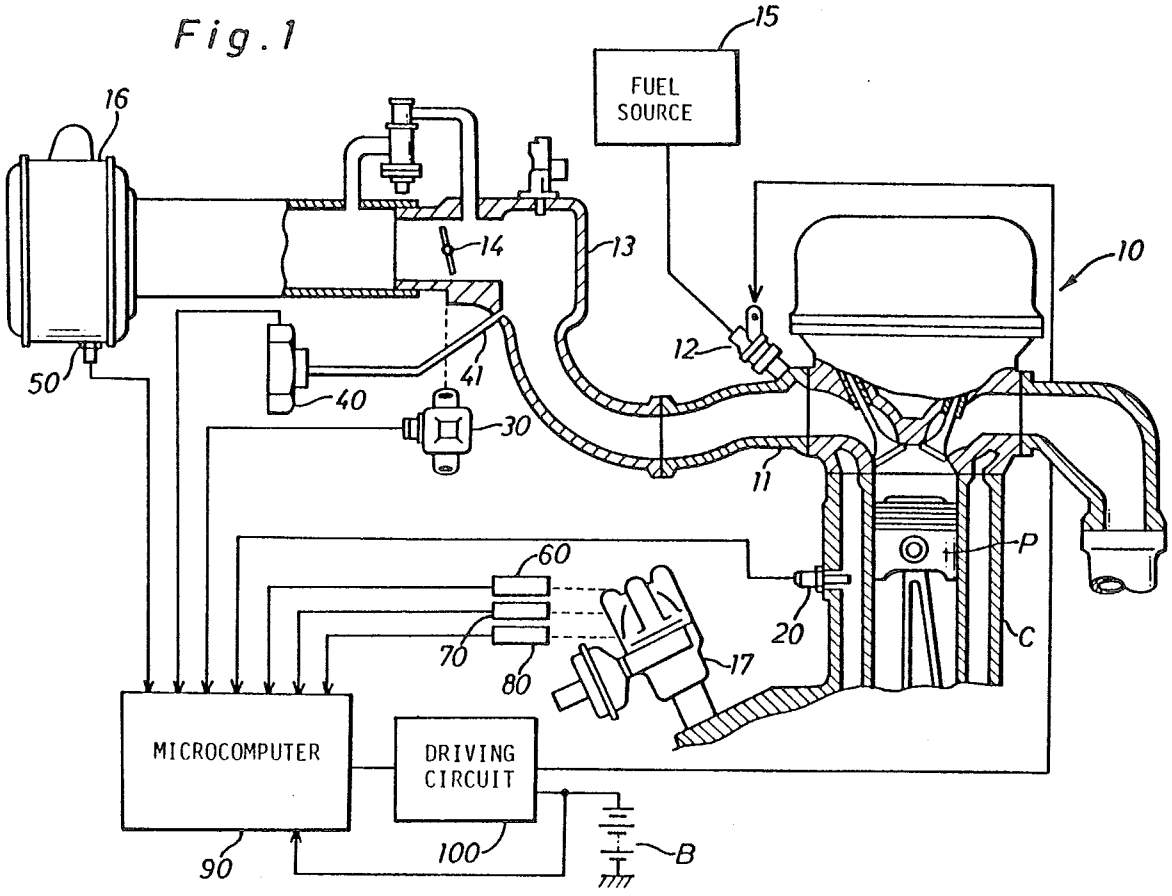
FIG. 1 is a schematic block diagram of an electronic fuel injection control device for an internal combustion engine in accordance with the present invention.
Figure 2:
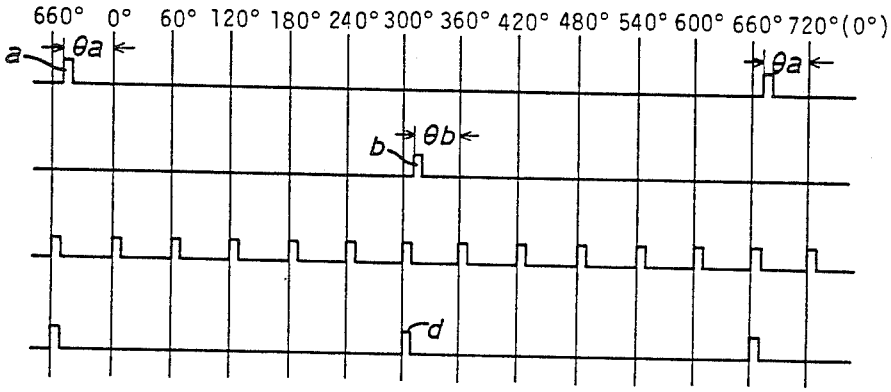
FIG. 2 illustrates waveforms obtained at various points in the control device.

Referring now to the drawings, FIG. 1 illustrates an electronic fuel injection control device of the present invention which is adapted to an internal combustion engine 10 with six cylinder barrels. The electronic fuel injection control device comprises an water temperature sensor 20, a throttle position sensor 30, a negative pressure sensor 40, a suction air temperature sensor 50, standard angle sensors 60, 70 and a rotational angle sensor 80. The water temperature sensor 20 is arranged to detect a temperature $T_w$ of cooling water in a cooling system of the engine 10 so as to produce a first signal indicative of the detected temperature $T_w$. The throttle position sensor 30 is arranged to detect an opening degree $\theta$ of a throttle valve 14 in an air induction pipe 13 of the engine 10 so as to produce a second signal indicative of the detected throttle opening degree $\theta$. The negative pressure sensor 40 is connected to a conduit 41 extending from a downstream portion of the throttle valve 14 to detect a negative pressure $P_s$ in air induction pipe 13 so as to produce a third signal indicative of the detected negative pressure $P_s$. The suction air temperature sensor 50 is arranged to detect a temperature $T_A$ of suction air flowing through an air filter 16 into the induction pipe 13 so as to produce a fourth signal indicative of the detected temperature $T_A$. The respective standard angle sensors 60, 70 and the rotational angle sensor 80 are mounted on a cam shaft of a distributor assembly 17 of the engine 10. The first standard angle sensor 60 is arranged to detect a first standard rotational angle of the engine 10 per one rotation of the cam shaft corresponding with two rotations of the engine crankshaft. Thus, the sensor 60 produces a first standard signal a indicative of the first standard rotational angle of the engine 10. As is illustrated in FIG. 2, the first standard rotational angle of the engine may correspond with a predetermined advance angle a in relation to a rotational angle of the engine crankshaft e.g. a crank angle 0° which corresponds with an upper dead point of a first piston P in a first cylinder barrel C of the engine 10.

The second standard angle sensor 70 is arranged to produce a second standard signal b indicative of a second standard rotational angle of the engine 10 which corresponds with a predetermined advance angle b in relation to a crank angle 360°. The rotational angle sensor 80 is arranged to successively detect a series of predetermined rotational angles per half rotation of the cam shaft so as to produce a series of rotational angle signals c. see (FIG. 2) The series of predetermined rotational angles may correspond with integer times of a crank angle width 60° respectively in relation to the crank angle 0°. This means that the number of rotational angle signals c per one rotation of the engine crankshaft are equal to the number of the cylinder barrels.

A microcomputer 90 includes an A-D converter of the progressive conversion type which is arranged to convert the signals from sensors 20, 30, 40 and 50 and a direct current voltage from a source of direct current B to first, second, third, fourth and fifth digital signals. The microcomputer 90 is arranged to execute a main control program based on a flow chart (not shown) in an usual manner. During the execution of the main control program, the computer 90 calculates a rotational speed N of the engine 10 in response to the rotational angle signal c from sensor 80 and further calculates adjustment values $K_W$, $K_\theta$, and $K_A$ in response to the first, third and fourth digital signals, which adjustment values $K_W$, $K_{\theta\ and\ KA}$ are used to adjust a standard injection time $\tau$ corresponding with a standard injection quantity of fuel supply into the engine 10. Additionally, the computer 90 calculates an adjustment value $\tau_v$ in response to the fifth digital signal for further adjustment of the adjusted injection time $\tau_1$.

Figure 3:
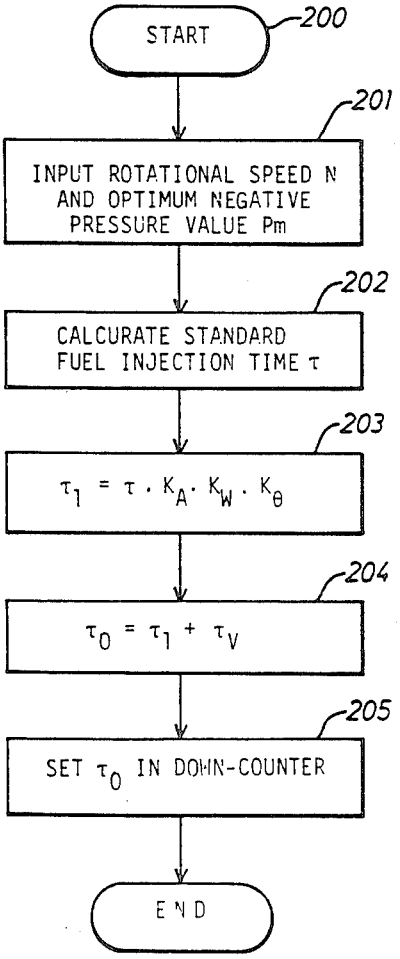
FIG. 3 is a flow chart illustrating a first interruption control program.
Figure 4:
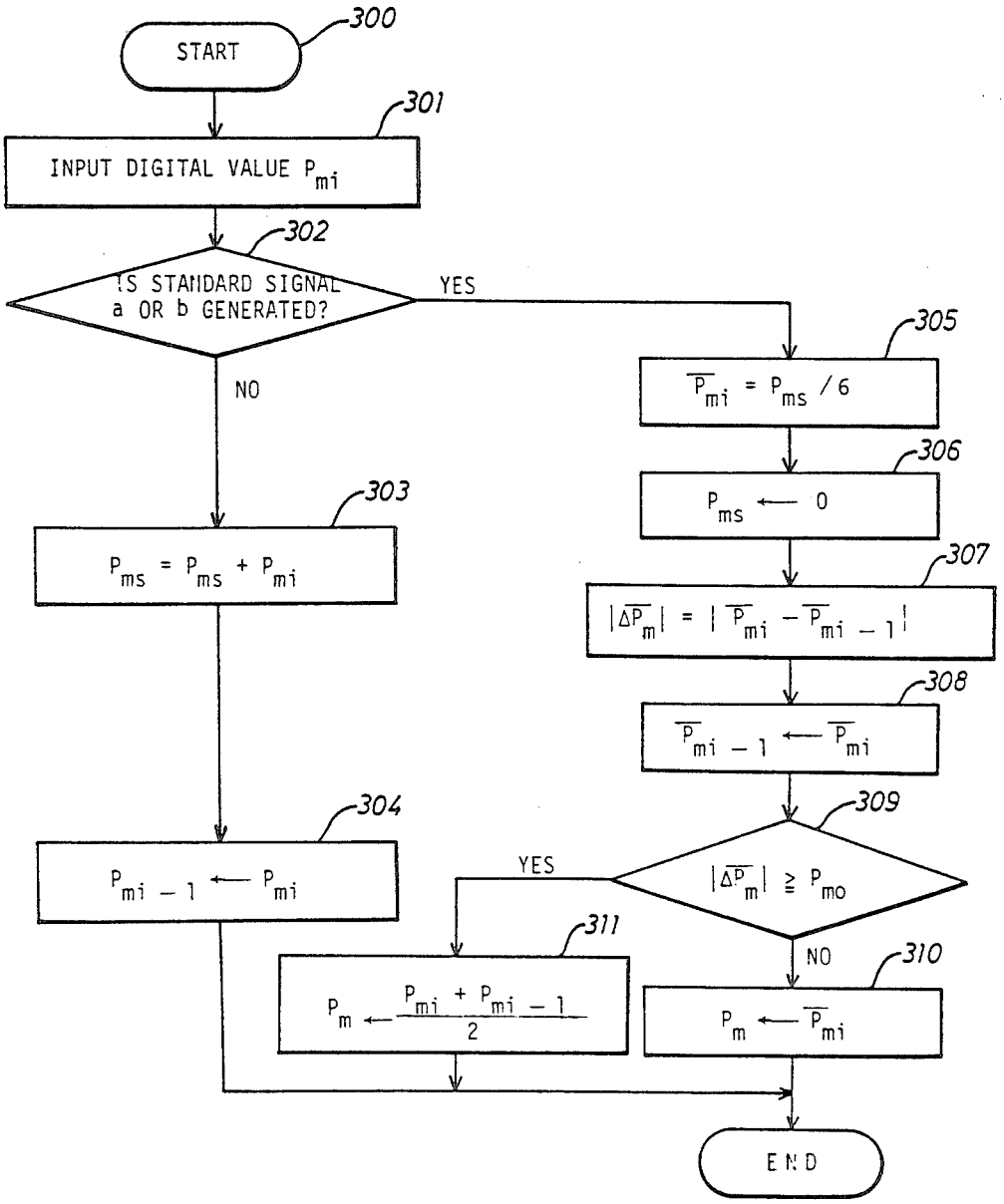
FIG. 4 is a flow chart illustrating a second interruption control program.

Furthermore, the computer 90 is arranged to execute first and second interruption control programs based on flow charts respectively illustrated in FIGS. 3 and 4. During execution of the second interruption control program, the computer 90 is responsive to the first and second standard signals a, b from sensors 60 and 70 to average a value of the third digital signal respectively in accordance with normal and transient operation of the engine 10. In this instance, the value of the third digital signal represents a digital value $P_{mi}$ corresponding to a negative pressure $P_s$. During execution of the first interruption control program, the computer 90 carries out various calculations for a down-counter in the computer 90 in dependence upon respective values obtained by execution of the main control program and the second interruption control program. The timing for execution of the first interruption control program is determined by a divisional frequency signal d, and the timing for execution of the second interruption control program is determined by the rotational angle signal c from sensor 80. The divisional frequency signal d is obtained by dividing a frequency of the rotational angle signal c from sensor 80 into 1/6 in response to the first standard signal a from sensor 60 or the second standard signal b from sensor 70. As is illustrated in FIG. 2, the divisional frequency signal d occurs per 360° in relation to a standard crank angle 300°.

A driving circuit 100 is arranged to selectively permit an electric power supply from the source of direct current B to fuel injection valves 12 of the engine 10 under control of the computer 90. In such an arrangement, the respective fuel injection valves 12 are mounted on an intake manifold 11 of the engine 10 to be selectively energized in response to a drive signal from the driving circuit 100 to effect fuel injection into each combustion chamber of the cylinder barrels of the engine from the source of fuel 15.

In operation, assuming that the opening degree of throttle valve 14 is maintained at a value under operative condition of the fuel injection control device to run the vehicle at a desired speed, the computer 90 executes the main control program to calculate the rotational speed N of the engine and the adjustment values $K_W$, $K_\theta$, $K_A$ and $\tau_v$. When received a rotational angle signal c from sensor 80, the computer 90 halts the execution of the main control program and initiates execution of the second interruption control program at a step 300 of the flow chart of FIG. 4 to temporarily store a value $P_{mi}$ of the third digital signal from the converter at a step 301 of the program. When the first and second standard signals a and b do not occur at a step 302 of the program, the computer 90 determines a "NO" answer, and the program proceeds to a step 303 where the computer 90 adds an addition value $P_{ms}$ to the digital value $P_{mi}$ to renew the added resultant value for an addition value $P_{ms}$. At the initial stage, the addition value $P_{ms}$ is determined to be zero in the initialization at step 300. When the program proceeds to a step 304, the computer 90 renews the digital value $P_{mi}$ for a digital value $P_{mi-1}$. Subsequently, the computer 90 repeats the above calculation in response to the rotational angle signal c from sensor 80 to repeat renewal of the addition value $P_{ms}$ and the digital value $P_{mi}$ respectively at steps 303 and 304 of the program.

When received the first standard angle signal a from sensor 60 under the above condition, the computer 90 determines an "YES" answer at step 302, and the program proceeds to a step 305 where the computer 90 divides a newest addition value $P_{ms}$ by six (6) and sets the divided value as an average value $\overline{P}_{mi}$. Subsequently, the computer 90 sets the addition value $P_{ms}=0$ at a step 306 of the program and renews the average value $\overline{P}_{mi}$ for a value $P_{mi-1}$ at a step 308. When received the second standard angle signal b from sensor 70 during repetitive execution of the program from step 300 to step 304, the computer 90 determines an "YES" answer at step 302, and the program proceeds to step 305 where the computer 90 determines the average value $\overline{P}_{mi}$ based on the newest addition value $P_{ms}$. Subsequently, the computer 90 sets the addition value $P_{ms}=0$ at step 306 of the program.

When the second interruption program proceeds at a step 307, the computer 90 calculates an absolute value $|\Delta\overline{P}_m|=|\overline{P}_{mi}-\overline{P}_{mi-1}|$ of a difference between the average value $\overline{P}_{mi}$ at step 305 and the value $\overline{P}_{mi-1}$ at step 308, and the program proceeds to a step 309 through step 308. As the vehicle is running at a constant speed at this stage, the absolute value $|\Delta\overline{P}_m|$ of the difference is smaller than a predetermined negative pressure value $P_{mo}$ indicative of a transient operation of the engine which is previously memorized in the computer 90. For this reason, the computer 90 determines a "NO" answer at the step 309, causing the program to go to a step 310. Thus, the computer 90 sets a newest average value $\overline{P}_{mi}$ as an optimum negative pressure value $P_m$ at step 310. This means that an absolute value $|\Delta\overline{P}_m|$ of the difference between the preceding average value $P_{mi-1}$ at step 308 and following the average value $\overline{P}_{mi}$ at step 305 is smaller than the predetermined negative pressure value $P_{mo}$ and that the newest average value $\overline{P}_{mi}$ is set as the optimum negative pressure value $P_m$. In this instance, the average value $\overline{P}_{mi}$ at step 305 is determined by the addition value $P_{ms}$ after the addition has been carried out six times at step 303 during one rotation of the engine 10.

Thus, the computer 90 initiates execution of the first interruption control program in response to a divisional frequency signal d at a step 200 of the program. When the program proceeds to a step 201 of the program, the computer 90 temporarily stores the rotational speed N and the optimum negative pressure value $P_m$, the former being calculated in the main control program, and the latter being calculated at step 310 of the second interruption control program. Subsequently, at a step 202 of the program, the computer 90 calculates a standard fuel injection time $\tau$ based on a map (not shown) representing a relationship among the standart fuel injection time $\tau$, the rotational speed N and the optimum negative pressure value $P_m$. At the following step 203 of the program, the computer 90 multiplies the standard fuel injection time $\tau$ by the adjustment values $K_A$, $K_W$ and $K_\theta$ to set the multiplied value as an adjusted standard fuel injection time $\tau_1$. When the program proceeds to a step 204, the computer 90 adds the adjustment value $\tau_v$ to the multiplied value $\tau_1$ to set the added value as an optimum fuel injection time $\tau_0$ and to set it in the down-counter at a final step 205 of the program.

When applied with the optimum fuel injection time $\tau_0$, the down-counter of computer 90 produces an output signal therefrom and initiates downcount of the optimum fuel injection time $\tau_0$. Subsequently, the driving circuit 100 produces a drive signal therefrom in response to the output signal from the down-counter, and the fuel injection valves 12 are energized in response to the drive signal to effect fuel supply into the engine 10 from the fuel source 15. When the downcount of the optimum fuel injection time $\tau_0$ terminates, the down-counter of computer 90 ceases generation of the output signal to cause disappearance of the drive signal from the drive circuit 100, and in turn, the fuel injection valves 12 are deenergized to cease the fuel supply into the engine 10.

From the above description, it will be understood that when the vehicle is running at a constant speed, the optimum fuel injection time $\tau_0$ is calculated on a basis of the optimum negative pressure value $P_m=\overline{P}_{mi}$ which corresponds with an average of six digital values $P_{mi}$ during one rotation of the engine 10. As a result, even when a value $P_s$ of the third signal from sensor 40 pulsates, the optimum fuel injection time $\tau_0$ can be determined as a stable value to ensure stable fuel injection into the engine 10 thereby to effect smooth rotation of the engine.

Assuming that the vehicle is in a transient running condition such as quick acceleration during execution of the above-described programs, the computer 90 determines an "YES" answer at step 309 of the second interruption control program and calcuates a half of addition of digital values $P_{mi}$ and $P_{mi-1}$ at step 311 to set the calculated value as an optimum negative pressure value $P_m$. During execution of the first interruption control program, the computer 90 subsequently calculates an optimum fuel injection time $\tau_0$ on a basis of the optimum negative pressure value $P_m$ to set the calculated optimum fuel injection time $\tau_0$ in the down-counter of computer 90. Thus, the driving circuit 100 produces a drive signal in response to initiation of downcount of the optimum fuel injection time $\tau_0$ by the down-counter and maintains it until the downcount terminates. Thus, the fuel injection valves 12 are energized in response to the drive signal to effect fuel injection into the engine 10.

From the above description, it will be understood that under a transient condition in operation of the engine, the optimum negative pressure value $P_m$ is determined by an average of addition of a newest digital value $P_{mi}$ during one rotation of the engine and the preceding digital value $P_{mi-1}$ to determine the optimum fuel injection time $\tau_0$ based on the optimum negative pressure value $P_m$. Thus, even if the A-D converter of the progressive conversion type operates at a high speed to convert high frequency noises together with the negative pressure signal from sensor 40 to a digital value, the computer 90 acts at step 311 of the program to average a digital value indicative of the high frequency noises. As a result, an error in the optimum negative pressure value $P_m$ caused by the high frequency noises reduces in comparison with that in an optimum negative pressure value based on a single digital value $P_{mi}$. For this reason, it is able to determine the optimum fuel injection time $\tau_0$ as precisely as possible to ensure reliable and stable control of fuel injection quantity into the engine 10. It should be understood that the optimum negative pressure value $P_m$ is determined by at least two newest digital values $P_{mi-1}$ and $P_{mi}$ which are successively converted during one rotation of the engine. As a result, the amount of fuel injection can be controlled in response to transient operation of the engine to ensure good driveability of the vehicle.

Figure 5:
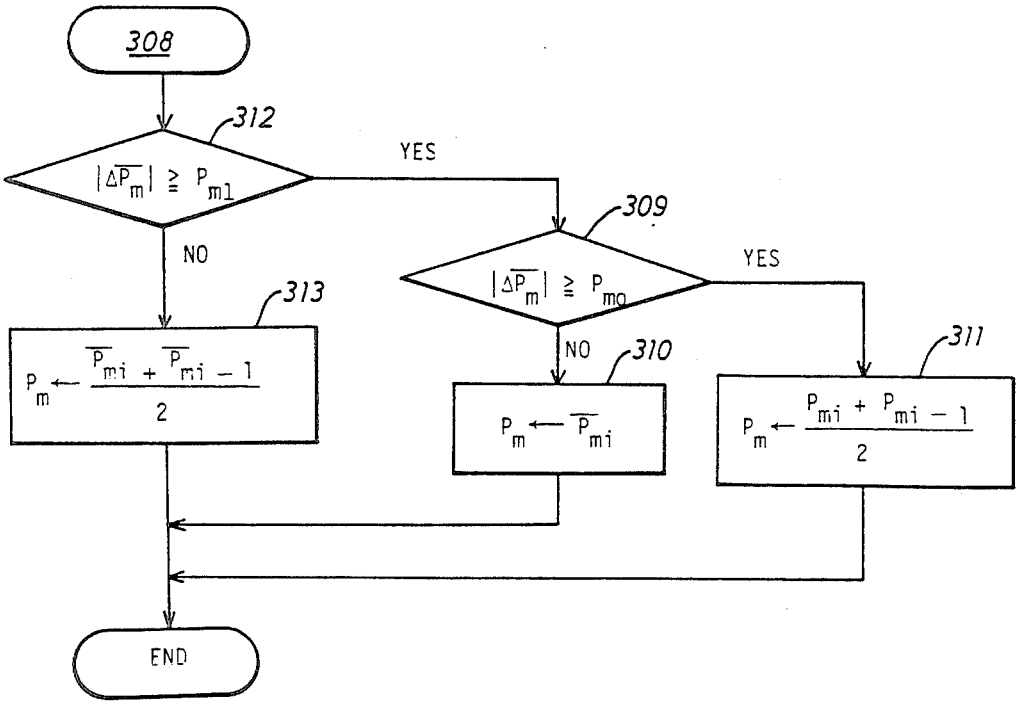
FIG. 5 is a flow chart illustrating a modification of the second interruption control program.

Although in the above-described embodiment a transient operaton of the engine 10 is discriminated only at step 309 of the second interruption control program, the steps 308 to 311 of the program may be modified as is illustrated in FIG. 5. When an abosolute difference value $|\Delta P_m|$ is smaller than a predetermined negative pressure value $P_{ml}$ ( $<P_{mO}$) indicative of a most stable operation of the engine, the computer 90 determines a "NO" answer at a step 312 of the modified program, and the program proceeds to the following step 313. Then, the computer 90 calculates a half of addition of newest avarage values $\overline{P}_{mi}$ and $\overline{P}_{mi-1}$ and sets the calculated value as an optimum negative pressure value $P_m$. This means that the optimum negative pressure value Pm is determined by an average of digital values $P_{mi}$ during two rotations of the engine in its most stable operation. When the computer 90 determines an "YES" answer at step 312, the same execution at steps 309 to 311 of the program is carried out.

Although in the above-described embodiment the optimum negative pressure value $P_m$ is determined by an average of addition of two successive digital values $P_{mi-1}$ and $P_{mi}$, it may be determined by an average of addition of three successive digital values $P_{mi-2}$, $P_{mi-1}$ and $P_{mi}$. Futhermore, in the actual practices of the invention, the negative pressure sensor 40 may be replaced with an air flow sensor for detecting an amount of suction air to produce a third signal indicative of the detected amount of suction air. In this instance, the predetermined negative pressure value $P_{mo}$ may be replaced with a predetermined amount of suction air, and the optimum negative pressure value $P_m$ may be replaced with an optimum amount of suction air.

Having thus described the preferred embodiments of the present invention it should be understood that various modifications and adaptations may be resorted to without departing from the spirit of the invention.

What is claimed is:

1. An electronic fuel injection control device for an internal combustion engine having a source of fuel, and electrically operated fuel injection means for effecting fuel supply into said engine from said source of fuel during energization thereof, said fuel injection control device comprising:

first detecting means for detecting rotational speed of said engine to produce a first signal indicative of the detected rotational speed;

second detecting means for detecting a physical value related to the operation of said engine to produce a second signal indicative of the detected physical value;

an analogue-to-digital converter for converting said second signal to a digital value;

means for providing an average of a plurality of said digital values successively converted during one rotation of said engine;

means for determining whether or not a difference between the preceding average of said digital values and the following average of said digital values is larger than a predetermined physical value indicative of a transient operation of said engine, if so determining a first optimum physical value based on an average of at least two digital values most newly converted during one rotation of said engine, and if not determining a second optimum physical value based on the average of said digital values;

means for determining an optimum fuel injection time based on one of said first and second optimum physical values and in relation to a value of said first signal and for producing an output signal indicative of said optimum fuel injection time; and means for energizing said fuel injection means in response to said output signal for said optimum injection time.

2. An electronic fuel injection control device for an internal combustion engine having a source of fuel, and electrically operated fuel injection means for effecting fuel supply into said engine from said source of fuel during energization thereof, said fuel injection control device comprising:

first detecting means for detecting rotational speed of said engine to produce a first signal indicative of the detected rotational speed;

second detecting means for detecting a physical value related to the operation of said engine to produce a second signal indicative of the detected physical value;

an analogue-to-digital converter for converting said second signal to a digital value;

means for providing an average of a plurality of said digital values successively converted during one rotation of said engine;

means for determining whether or not a difference between the preceding average of said digital values and the following average of said digital values is larger than a first predetermined physical value indicative of a stable operation of said engine, if so determining whether or not the difference between the preceding and following averages is larger than a second predetermined physical value indicative of a transient operation of said engine, and if not determining a first optimum physical value based on an average of the preceding and following averages;

means for determining a second optimum physical value based on an average of at least two digital values most newly converted during one rotation of said engine when the difference between the preceding and following averages is larger than said second predetermined physical value and for determining a third optimum physical value based on the average of said digital values when the difference between said averages is less than said second predetermined physical value;

means for determining an optimum fuel injection time based on one of said first, second and third optimum physical values and in relation to a value of said first signal and for producing an output signal indicative of said optimum fuel injection time; and means for energizing said fuel injection means in response to said output signal for said optimum injection time.

3. An electronic fuel injection control device according to claim 1, wherein said physical value is an intake manifold negative pressure in operation of said engine, and said predetermined physical value is a predetermined negative pressure value indicative of a transient operation of said engine.

4. An electronic fuel injection control device according to claim 2, wherein said physical value is an intake manifold negative pressure in operation of said engine, said first predetermined physical value is a first predetermined negative pressure value indicative of a stable operation of said engine, and said second predetermined physical value is a second predetermined negative pressure value indicative of a transient operation of said engine, said first predetermined negative pressure value being defined to be smaller than said second predetermined negative pressure value.

5. An electronic fuel injection control device according to claim 1, wherein said physical value is an amount of suction air in operation of said engine, and said predetermined physical value is a predetermined amount of suction air indicative of a transient operation of said engine.

* * * * *

UNITED STATES PATENT AND TRADEMARK OFFICE

CERTIFICATE OF CORRECTION

PATENT NO. : 4,747,387

DATED : 5/31/88

INVENTOR(S) : Mitsunori Takao and Takahiko Kimura

It is certified that error appears in the above-identified patent and that said Letters Patent is hereby corrected as shown below:

The term of this patent subsequent to January 31, 2004, has been disclaimed.

Signed and Sealed this

Nineteenth Day of September, 1989

*Attest:*

DONALD J. QUIGG

*Attesting Officer*

*Commissioner of Patents and Trademarks*